US007096901B2

(12) United States Patent
Brazzola

(10) Patent No.: US 7,096,901 B2
(45) Date of Patent: Aug. 29, 2006

(54) MANUALLY OPERATED APPARATUS FOR SPLITTING WOOD

(75) Inventor: Luigi Brazzola, Castel San Pietro (CH)

(73) Assignee: Wonder Link Ltd., Majuro, MH (US)

( * ) Notice: Subject to any disclaimer, the term of this patent is extended or adjusted under 35 U.S.C. 154(b) by 134 days.

(21) Appl. No.: 10/838,372

(22) Filed: May 5, 2004

(65) Prior Publication Data

US 2005/0016629 A1 Jan. 27, 2005

(30) Foreign Application Priority Data

May 6, 2003 (CH) ..... 0787/03

(51) Int. Cl.
*B27L 7/00* (2006.01)

(52) U.S. Cl. ..... 144/195.2; 144/193.1; 144/195.4

(58) Field of Classification Search ..... 144/193.1, 144/195.2, 4.6, 366, 195.4, 195.6, 195.9
See application file for complete search history.

(56) References Cited

U.S. PATENT DOCUMENTS 1,701,001 A * 2/1929 Hampton ..... 144/193.1
3,515,372 A * 6/1970 Courville ..... 254/104
3,916,966 A * 11/1975 Johnston et al. ..... 144/366
3,982,572 A * 9/1976 Kortendick ..... 144/195.7
4,211,264 A * 7/1980 Cross ..... 144/195.7
4,244,407 A * 1/1981 McMullin ..... 144/195.4
4,535,980 A * 8/1985 Jordan ..... 269/102
4,553,576 A * 11/1985 Maingueneau ..... 144/194
4,782,867 A * 11/1988 Forsyth ..... 144/195.2
4,782,868 A * 11/1988 Coller et al. ..... 144/195.1
4,898,220 A * 2/1990 Maingueneau ..... 144/194

FOREIGN PATENT DOCUMENTS

DE 28149 7/1984
DE 3514800 10/1986

* cited by examiner

*Primary Examiner*—Bena Miller
(74) *Attorney, Agent, or Firm*—Greenblum & Bernstein, P.L.C.

(57) ABSTRACT

Manually operated apparatus for splitting wood includes at least one axe-shaped blade vertically arranged on a support base. The at least one axe-shaped blade has an upward facing cutting edge. The axe-shaped blade is structured and arranged to receive thereon a lower end of a piece of wood so that the piece of wood can be split by a hammer blow directed to an upper end of the piece of wood. A saddle member is coupled to the support base. The saddle member is structured and arranged to allow the piece of wood to lean against the saddle member and to hold the piece of wood upright at the moment when the piece of wood receives the hammer blow. This Abstract is not intended to define the invention disclosed in the specification, nor intended to limit the scope of the invention in any way.

33 Claims, 4 Drawing Sheets

MANUALLY OPERATED APPARATUS FOR SPLITTING WOOD

CROSS-REFERENCE TO RELATED APPLICATIONS

The present application claims priority under 35 U.S.C. § 119 of Swiss Patent Application No. 2003 0787/03 filed May 6, 2003, the disclosure of which is expressly incorporated by reference herein in its entirety.

BACKGROUND OF THE INVENTION

1. Field of the Invention

The present invention concerns a manually operated apparatus for splitting wood.

2. Discussion of Background Information

The operation of manually splitting wood, i.e., without the help of expensive machines that are difficult to transport, and that is unsuitable in daily use, is effected todays as always in all regions of the world, out of necessity or as healthy sport training. The operation as a rule consists of placing a piece of wood to be split into two or more pieces onto a base, often a block of wood, and hitting the piece of wood with an axe from above. This operation is not free of dangers, however, as demonstrated in the statistics concerning the accidents it provokes. Handling a sharp axe is a very dangerous action as such. In many cases, due to mistaken aim, or because the piece of wood to be split has moved, etc., the trajectory of the axe does not obey the intentions of the operator. As a result, the operator, in many cases, injures himself, especially in his legs, with sometimes severe consequences. Furthermore, it happens frequently that with the first axe blow, the piece of wood is not totally split but instead remains clamped on the axe. The woodcutter (this term being used to designate the person handling the axe) must therefore re-lift the axe with the piece of wood clinging to it, but not yet split, and to bang them onto the block again. This is a very difficult and dangerous operation as during the blow against the block, the piece of wood may liberate itself and fly away in any direction.

In order to avoid these disadvantages and dangers inherent in the operation of splitting wood using the traditional axe, various methods of operation have become known, which essentially are based on the idea of inverting the position of the cutting blade of the axe. Thus no longer does the axe hit the piece of wood from above but instead the piece of wood is banged from above against the blade with the help of a heavy hammer or sledgehammer. This procedure certainly aims to provide greater safety for the woodcutter with regard to all dangers inherent in the all around swing of the sharp axe in the air.

A proposal in this direction is e.g., described in the DE 35 14 800 C2, according to which the apparatus for splitting wood or similar material presents a separating element, i.e., a blade in the form of rays-extending from one point. The device has cutting edges which form a support surface for the piece of wood to be split. The cutting edges of the blade element extend inclined upwards from the central point.

This solution was aimed at improving a much older idea shown in the DE-PS-28149, which shows a star-shaped splitting element whose rays however, extend downward from the central point of intersection of the blades arranged in star shape. This type of known apparatus, and above all the first one cited, which certainly represents a clear progress over the old idea of the star-shaped blade according to the DE-PS-28149, still presents at least two important disadvantages in practical use, namely that:

a) it is not possible to split the piece of wood into less than three pieces. For a star-shaped blade used as a support at least three blades are required as shown in the FIGS. 2 and 3 of the DE 35 14 800 C2. Thus the piece of wood cannot be split simply in two pieces.

b) The support base of the piece of wood to be split, consisting of three or more blades arranged in star-form, does not ensure absolutely stable emplacement of the piece of wood. The piece of wood is arranged so as to be "balancing" on the support surface. As a result, the insecurity of the emplacement is all the greater the longer the piece of wood is and the smaller its diameter is. Thus, the danger persists that the piece of wood could escape at the moment of vibration during the first hammer blow and thus the blow could miss it and possibly could damage the apparatus or even injure the operator. It is to be noted that this danger disappears after the first blow, because, if the piece of wood is not split completely by the first blow, it remains clamped between the blades and no longer can fall from its "artificial block" (of which the apparatus, described in the two documents establishing the state of the art, and also the present invention, also could be characterized).

SUMMARY OF THE INVENTION

The present invention thus aims to eliminate the disadvantages cited of the state of the art and to propose a solution that ensures absolute work safety using an apparatus of the type described in DE 35 14 800 C2, and which in a particular embodiment presents a whole series of further advantages, which will be described in the following with reference to various illustrated examples of the invention.

The invention also provides for a manually operated apparatus for splitting wood, wherein the apparatus comprises at least one axe-shaped blade vertically arranged on a support base. The at least one axe-shaped blade has an upward facing cutting edge. The axe-shaped blade is structured and arranged to receive thereon a lower end of a piece of wood so that the piece of wood can be split by a hammer blow directed to an upper end of the piece of wood. A saddle member is coupled to the support base. The saddle member is structured and arranged to allow the piece of wood to lean against the saddle member and to hold the piece of wood upright at the moment when the piece of wood receives the hammer blow.

The at least one axe-shaped blade may be inclined towards a position wherein a person delivers the hammer blow. The at least one axe-shaped blade may comprise at least one wedge-shaped spreading element. The at least one wedge-shaped spreading element may be arranged on at least one side of the at least one axe-shaped blade. The at least one wedge-shaped spreading element may be arranged on each side of the at least one axe-shaped blade. The at least one wedge-shaped spreading element may be arranged below and spaced from the cutting edge of the at least one axe-shaped blade. The at least one wedge-shaped spreading element may be arranged below and spaced from the cutting edge of the at least one axe-shaped blade by a few centimeters.

The at least one axe-shaped blade may comprise a plurality of axe-shaped blades. The plurality of axe-shaped blades may be arranged in on a common plane. The plurality of axe-shaped blades may be arranged crosswise.

The at least one axe-shaped blade may comprise a crossed blade arrangement. The cross-blade arrangement may have the form of a star with at least three points, whereby the piece of wood can be split into three or more pieces.

The cutting edge may comprise a plurality of separated cutting edges. The cutting edge may comprise a convex cutting edge.

The saddle member may be pivotally connected to the support base. The saddle member may be movable between a rest position wherein the saddle member essentially hugs the support base and a working position.

The apparatus may further comprise an arrangement for securing the saddle member in a working position. The apparatus may further comprise a protecting element having a portion which can be moved between a position covering the cutting edge and another position which is not covering the cutting edge. The portion may comprise a bonnet cover. The bonnet cover may be made from one of sheet metal and a plastic material. The protecting element may comprise a pedal which is structured and arranged for activation by an operator.

The at least one axe-shaped blade may be removably fastened to the support base via a fastener. The at least one axe-shaped blade may comprise a through opening, whereby the through opening allows the at least one blade to be removably attached to the support base one of during transport of the apparatus and in a position which is parallel to the support base. The saddle member may be structured and arranged to tilted down onto the support base so as to assume a volume which can be easily transported manually. The at least one axe-shaped blade may be one of solidly fixed to the support base and removably fixed to the support base. The at least one axe-shaped blade may comprise a hard material. The hard material may comprise a hardened steel. Some portions of the apparatus may comprise one of a low strength steel and wood.

The invention also provides for a method of splitting wood in the apparatus, wherein the method comprises arranging the lower end of the piece of wood on the cutting edge of the at least one axe-shaped blade, holding the piece of wood upright with the saddle member, and directing a hammer blow to an upper end of the piece of wood.

The invention also provides for a manually operated apparatus for splitting wood, wherein the apparatus comprises at least one axe-shaped blade extending from a support base. The at least one axe-shaped blade has an upward facing cutting edge, wherein the axe-shaped blade is structured and arranged to receive thereon a lower end of a piece of wood so that the piece of wood can be split by a hammer blow directed to an upper end of the piece of wood. A saddle member comprises a portion which is structured and arranged to hold the piece of wood upright at the moment when the piece of wood receives the hammer blow.

The invention also provides for a method of splitting wood in the apparatus, wherein the method comprises arranging the lower end of the piece of wood on the cutting edge of the at least one axe-shaped blade, holding the piece of wood upright with the portion of the saddle member, and directing a hammer blow to an upper end of the piece of wood.

The invention also provides for a manually operated apparatus for splitting wood, wherein the apparatus comprises at least one axe-shaped blade removably connected to a support base. The at least one axe-shaped blade has an upward facing cutting edge, wherein the axe-shaped blade is structured and arranged to receive thereon a lower end of a piece of wood so that the piece of wood can be split by a hammer blow directed to an upper end of the piece of wood. A movably mounted saddle member comprises a portion which is structured and arranged to hold the piece of wood upright at the moment when the piece of wood receives the hammer blow.

The invention also provides for a method of splitting wood in the apparatus, wherein the method comprises arranging the lower end of the piece of wood on the cutting edge of the at least one axe-shaped blade, holding the piece of wood upright with the portion of the saddle member, and directing a hammer blow to an upper end of the piece of wood.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein it is shown in the.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
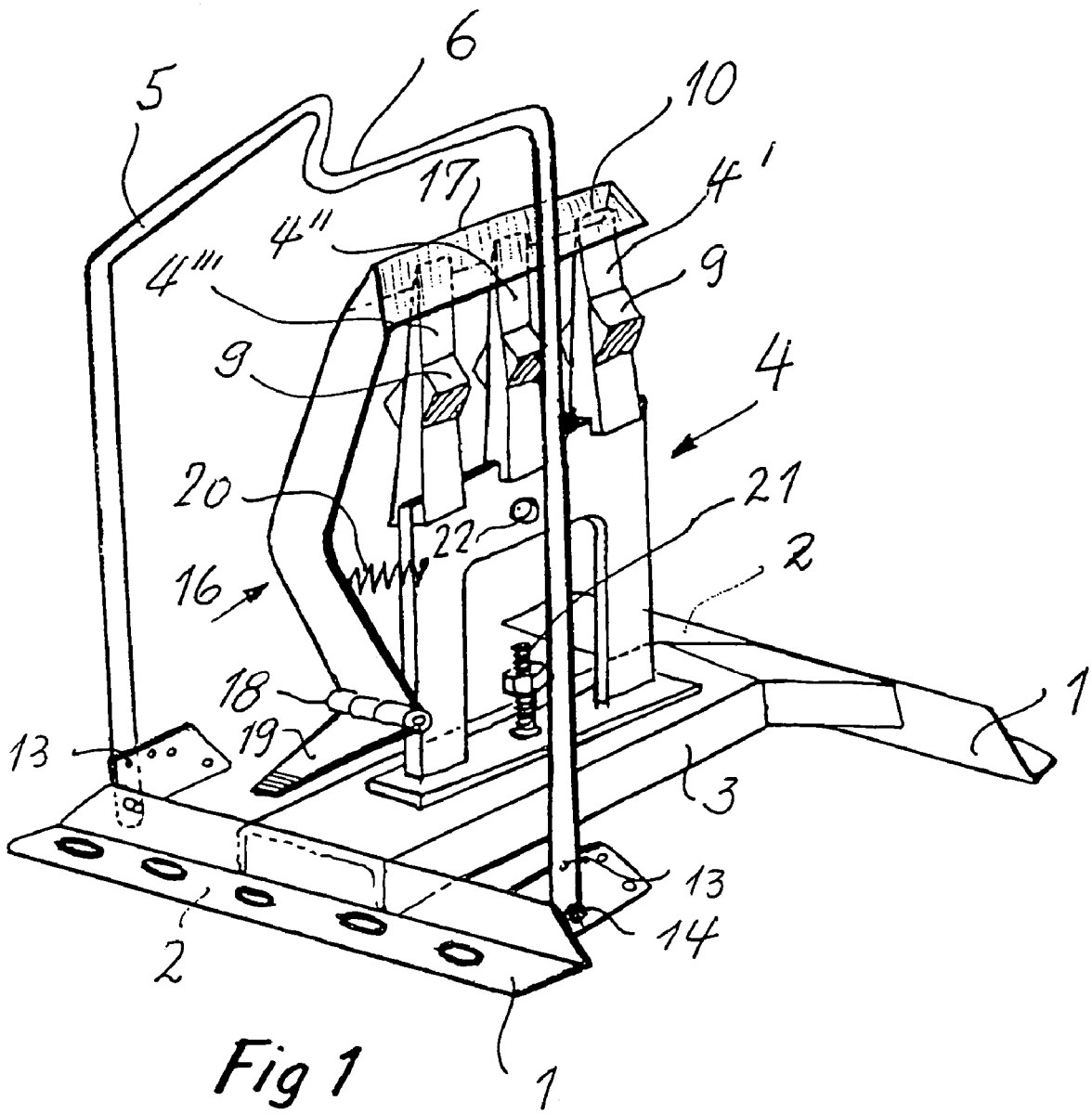
FIG. 1 shows an axonometric view of an inventive apparatus in its working position, and also shows one of the preferred variants of the splitting blade.

In FIG. 1 the inventive apparatus is shown with all its main components. The apparatus is shown with some elements, which can be considered as options.

A support base 1 in the form of a frame consists e.g. of two angled profiles 2 interconnected by a transverse member 3. This forms a rigid structure, which ultimately could be a single plate pressed into suitable form.

On the transverse member 3 is arranged a splitting blade 4 in the form of an axe turned upward is fixed. The specific shape of this splitting blade 4 may vary considerably within the scope of the present invention, and on the other hand it should be noted that the combination of a support base 1 and a vertical splitting blade 4 corresponds to an arrangement known according to the previous state of the art.

Figure 4:
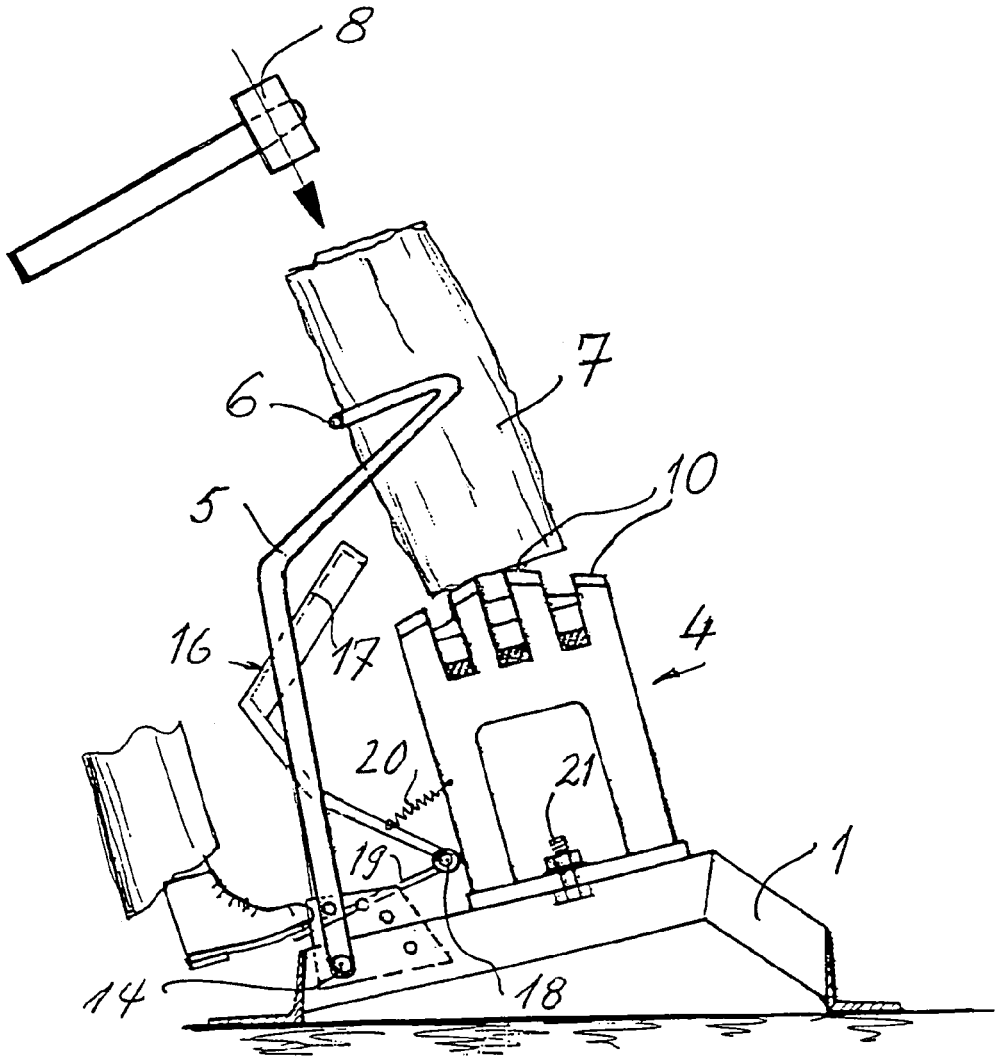
FIG. 4 shows an apparatus according to the FIG. 2 in its working position with the piece of wood ready to be split. The bonnet-shaped protection cover is removed from the field of operation.

Arranged on the support base 1 according to the invention is a saddle member 5 in the form of a yoke presenting in its upper portion a concave zone 6 against which, in its working position, the piece of wood 7 to be split rests (FIG. 4). The function of this saddle member 5 is thus to hold the piece of wood 7 upright before the hammer 8 (FIG. 4) comes down onto the upper end of the piece of wood 7. The use of this saddle member 5 renders the apparatus for splitting wood according to the present invention original and inventive. As the piece of wood 7, before engaging the blade 4, is held upright by the saddle member 5, and leans against the concave zone 6 of the yoke shaped saddle member 5 respectively, any danger is avoided that the piece of wood 7 could escape from its support and provoke the dangers described earlier with reference to the state of the art.

Figure 2:
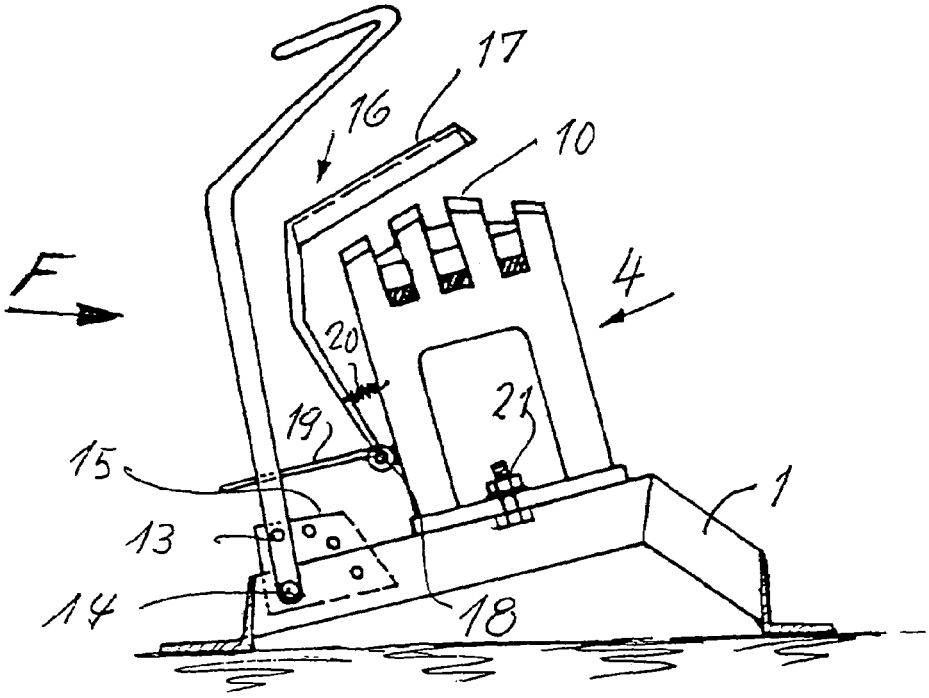
FIG. 2 shows a lateral view of an apparatus according to the FIG. 1, but with a blade form which slightly differs from the one shown in the FIG. 1, but also according to a preferred variant.

To further increase the stability of the piece of wood 7 on the cutting edge of the splitting blade 4, and thus to increase the safety of the apparatus, according to a first embodiment, shown in the FIGS. 2 and 4, the blade 4 is arranged in such a manner that it is inclined towards the position at which the operator handling the hammer 8 is standing. The saddle member 5, as shown in the FIG. 4, holds up the piece of wood 7 in such a manner that it is also inclined towards the operator and leans against the saddle member 5, or against the concave zone 6 thereof respectively. As a result, the wood 7 is held with correspondingly more pressure and thus is centered more stably.

Figure 3:
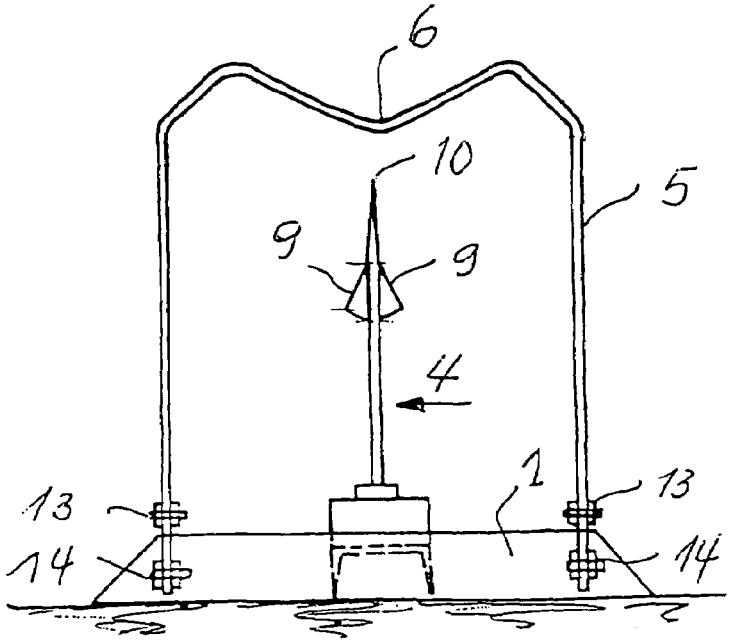
FIG. 3 shows a simplified lateral view of an apparatus according to FIG. 1 in the direction of the arrow F indicated in the FIG. 2. Some elements are not shown for better clarity of the figure.

According to another embodiment of the present invention the splitting blade 4 is provided with one or more spreading elements 9 which have the form of a wedge (see the FIGS. 1 and 3, which are particularly clear in this context) arranged on one or on both sides of the blade 4 at a distance of a few centimeters (cm) (e.g. 4 to 5 cm) below the sharp edge 10 of the blade 4. Practical experience has shown that spreading element 9 helps to widen the cleft in the piece of wood 7 opened by the blade 4 and frequently effects the total splitting of the piece of wood 7 in the first blow.

Figure 6:
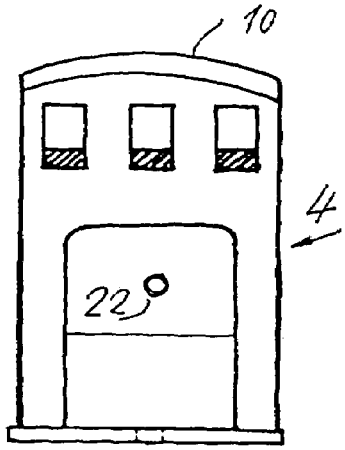
Figure 7:
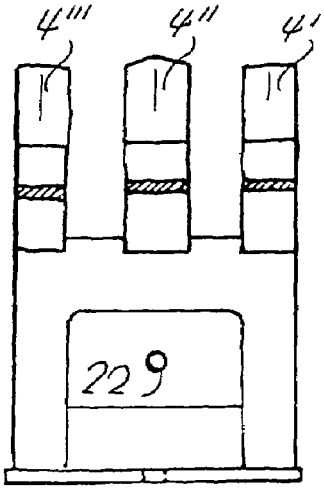

The shape of the blade 4 can be chosen from among many types: The simplest form is the one which utilizes only one axe or cutting edge as shown e.g. in FIG. 6. A similar blade presents a straight cutting edge or, as shown in FIG. 6, slightly convex cutting edge, which facilitates the emplacement of the piece of wood 7 before the first hammer blow is effected, whereby the piece of wood 7 engages the blade with a convex profile, or one with points, more easily, and more or less automatically.

According to another embodiment of the present invention, represented in the FIGS. 1, 2, 4, 5 and 7, a plurality of blades $4^{I}$ to $4^{IV}$ having the form of an axe are provided, whereby all of the blades are arranged in the same plane. Between the individual blades there can be arranged an interspace which interspace does not include a cutting edge. Practical experience has shown that this arrangement frequently facilitates the penetration of the blades into the piece of wood 7. Furthermore this arrangement permits material savings in the manufacturing the blade, because the material of the blade is always expensive and hard to process.

Figure 8:
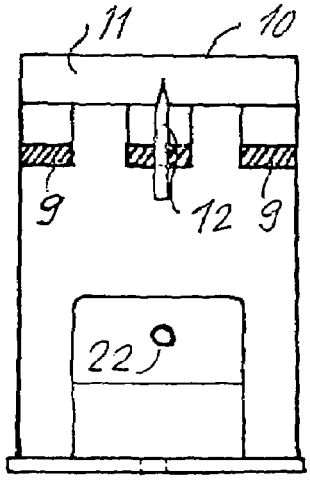

FIG. 8 shows schematically an embodiment using crossed blades, according to the known state of the art. The blade 11 is arranged at right angles with respect to the blade 12, thus forming a structure of a four-armed cross, which splits the piece of wood into four equal pieces. Also, in this case, spreading elements 9 can be arranged on one or more of the blades 10 or 11, if this is deemed necessary.

One of the further characteristics of the present invention is the ease with which the manually operated apparatus for splitting wood is transported to the working place. The ease of transport of the apparatus must be similarly easy as transporting an axe, with the difference however, owing to the inventive idea, that the latter dispenses with the use of a support block, as the apparatus itself forms a support.

Figure 9:
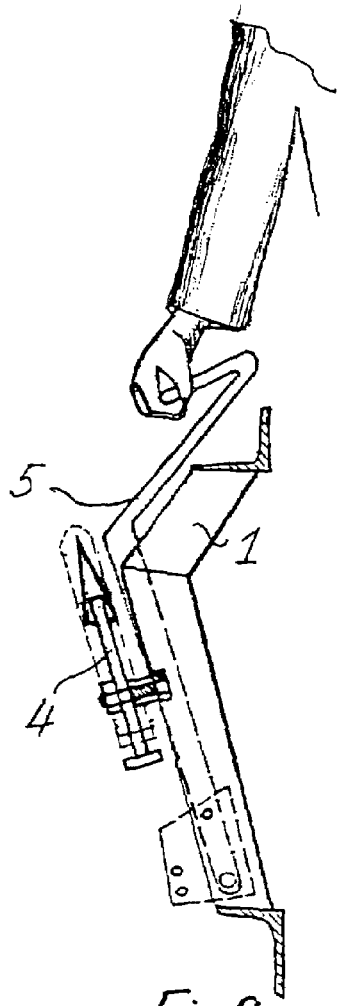
FIG. 9 shows an apparatus folded down on itself for easy transport.

For facilitating the transport of the inventive apparatus according to the present invention the saddle member 5 is fixed to the support base 1 in a tiltable manner such that it can be brought from a rest position, essentially folded down onto the support base 1, as shown in the FIG. 9 (showing the apparatus being transported—in vertical position—by an operator), to a working position (shown in FIGS. 1 through 4).

Fastening devices, e.g., screws are provided for fixing the saddle member 5 in its working position. The simplest way of permitting tilting of the saddle member 5 from an essentially vertical working position into an essentially horizontal position (or more precisely, parallel to the support base 1) is to install pivoting axles 14 to the lower ends of the saddle member 5 and to provide the frame 1 with two shoulders 15 containing openings, which permit fixation of the saddle member 5 in suitable positions. Of courses this solution is only one of the many solutions imaginable, all of which permit solving the problem of suitably tilting the saddle member 5 onto the frame 1.

According to a further embodiment of the present invention, illustrated in the FIGS. 1, 2 and 4, the manually operated apparatus for splitting wood is provided with a protecting element 16 which protects against accidents. The protecting element 16 is a bonnet-shaped blade cover 17 made from sheet metal, which, in its rest position shown in the FIGS. 1 and 2, covers the sharp edge of the blade 4. During use, the protecting bonnet 16 can be taken off by pivoting it about a pivoting axle 18 fixed with respect to the blade 4 in such a manner that the blade itself is set free. For this purpose, the protecting bonnet 16 is provided with a pedal 19 which is arranged on the opposite side of the bonnet 17, and which is activated by the operator as shown in the FIG. 4, at the moment when the piece of wood 7 is placed onto the blade 4 and against the saddle member 5. The protection element 16 which protects against accidents is provided with a tension spring 20. The tension spring 20 brings the protection element 16 back to its rest position, i.e., to a position in which the bonnet-cover 17 covers the blade 4 as soon as the operator removes his foot from the pedal 19. The variant shown, of course, represents just one of the many possible variants of a protecting element 16 which protects against accidents that can be realized within the scope of the invention. The importance of the protecting element 16 is such that the activation of the protecting element 16 by the operator is compulsory, if he wants to split wood.

According to a further embodiment of the present invention, the objective of which is to facilitate transport of the apparatus from one place of work to another, the blade 4; 11, 12, in form of an axe, is fastened to the support base 1 using a screw 21. Furthermore, the blade 4; 11, 12 is provided with an opening 22 extending through the blade 4; 11, 12, using which the blade can be fastened to the support base in a position parallel to said support base 1 as shown in the FIG.

Figure 5:
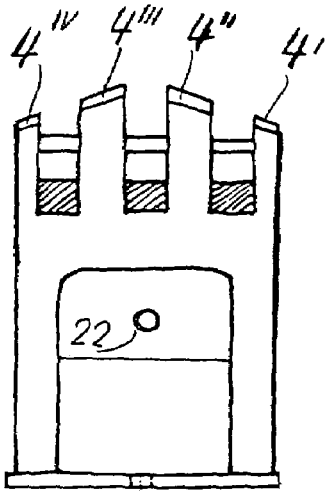
FIGS. 5–8 show various preferred shapes of the blade.

9. In this way, after tilting down the saddle member 5 the apparatus now presents a small volume and can easily be transported manually. FIG. 9 illustrates by way of example a manner in which the operator can hold the "folded-down" apparatus using the saddle member 5. FIG. 5 illustrates also that the dimensions of the apparatus are essentially lower than the height of the operator's hands above ground.

According to a further embodiment of the present invention the blade 4 (or the blades $4^{I}$–$4^{IV}$ respectively) or the crossed blades 11, 12 are solidly fixed to the support base 1 in such a manner that they are interchangeable, e.g., with the help of a screw 21, and can be easily exchanged in order to perform maintenance operations e.g., sharpening, or replacement, of the blade or blades 4.

According to another embodiment of the present invention the blade 4; 11, 12 be made from a hard material, e.g., of hardened steel, whereas the other parts can be made from less expensive materials, in particular, from low strength steel, but which is suitable for laser cutting, or it can be made from wood or any other suitable type of material. This variant permits reduction of manufacturing cost of the apparatus and possibly a reduction of the weight of the apparatus so that it can be transported.

The advantages of the inventive apparatus are an absolute safety against the danger of accidents as well as the great ease of maintenance and of transport, and furthermore the exchangeability of the blades permitting adaptation of the apparatus to the most diverse types of wood to be split.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF THE ELEMENTS REFERRED TO IN THE FIGURES

1 Frame or support base
2 Angled profile
3 Transverse member
4 Blade
5 Saddle member
6 Concave zone
7 Piece of wood
8 Hammer or sledgehammer
9 Spreading element
10 Cutting edge of the blade
11 Blade
12 Blade
13 Screw
14 Pivoting axle
15 Shoulders
16 Protecting element against accidents
17 Bonnet-shaped cover
18 Rotational axis
19 Pedal
20 Spring
21 Screw
22 Opening

What is claimed is:

1. A manually operated apparatus for splitting wood, the apparatus comprising:

at least one axe-shaped blade vertically arranged on a support base;

the at least one axe-shaped blade having an upward facing cutting edge, wherein the at least one axe-shaped blade is structured and arranged to receive thereon a lower end of a piece of wood so that the piece of wood can be split by a hammer blow directed to an upper end of the piece of wood; and a saddle member pivotally mounted to the support base, wherein the saddle member is structured and arranged to allow the piece of wood to lean against the saddle member and to hold the piece of wood upright at the moment when the piece of wood receives the hammer blow.

2. The apparatus of claim 1, wherein the at least one axe-shaped blade is inclined towards a position wherein a person delivers the hammer blow.

3. The apparatus of claim 1, wherein the at least one axe-shaped blade comprises at least one wedge-shaped spreading element.

4. The apparatus of claim 3, wherein the at least one wedge-shaped spreading element is arranged on at least one side of the at least one axe-shaped blade.

5. The apparatus of claim 3, wherein the at least one wedge-shaped spreading element is arranged on each side of the at least one axe-shaped blade.

6. The apparatus of claim 3, wherein the at least one wedge-shaped spreading element is arranged below and spaced from the cutting edge of the at least one axe-shaped blade.

7. The apparatus of claim 3, wherein the at least one wedge-shaped spreading element is arranged below and spaced from the cutting edge of the at least one axe-shaped blade by a few centimeters.

8. The apparatus of claim 1, wherein the at least one axe-shaped blade comprises a plurality of axe-shaped blades.

9. The apparatus of claim 8, wherein the plurality of axe-shaped blades are arranged in on a common plane.

10. The apparatus of claim 8, wherein the plurality of axe-shaped blades are arranged crosswise.

11. The apparatus of claim 1, wherein the at least one axe-shaped blade comprises a crossed blade arrangement.

12. The apparatus of claim 11, wherein the cross-blade arrangement has the form of a star with at least three points, whereby the piece of wood can be split into three or more pieces.

13. The apparatus of claim 1, wherein the cutting edge comprises a plurality of separated cutting edges.

14. The apparatus of claim 1, wherein the cutting edge comprises a convex cutting edge.

15. The apparatus of claim 1, wherein lower ends of the saddle member are pivotally connected to the support base via two axles.

16. The apparatus of claim 1, wherein the saddle member is movable between a rest position wherein the saddle member essentially hugs the support base and a working position.

17. The apparatus of claim 1, further comprising an arrangement for securing the saddle member in a working position.

18. The apparatus of claim 1, further comprising a protecting element having a portion which can be moved between a position covering the cutting edge and another position which is not covering the cutting edge.

19. The apparatus of claim 18, wherein the portion comprises a bonnet cover.

20. The apparatus of claim 19, wherein the bonnet cover is made from one of sheet metal and a plastic material.

21. The apparatus of claim 18, wherein the protecting element comprises a pedal which is structured and arranged for activation by an operator.

22. The apparatus of claim 1, wherein the at least one axe-shaped blade is removably fastened to the support base via a fastener.

23. The apparatus of claim 1, wherein the at least one axe-shaped blade comprises a through opening, whereby the through opening allows the at least one blade to be removably attached to the support base one of during transport of the apparatus and in a position which is parallel to the support base.

24. The apparatus of claim 1, wherein the saddle member is structured and arranged to tilted down onto the support base so as to assume a volume which can be easily transported manually.

25. The apparatus of claim 1, wherein the at least one axe-shaped blade is one of solidly fixed to the support base and removably fixed to the support base.

26. The apparatus of claim 1, wherein the at least one axe-shaped blade comprises a hard material.

27. The apparatus of claim 26, wherein the hard material comprises a hardened steel.

28. The apparatus of claim 1, wherein some portions of the apparatus comprise one of a low strength steel and wood.

29. A method of splitting wood in the apparatus of claim 1, the method comprising:

arranging the lower end of the piece of wood on the cutting edge of the at least one axe-shaped blade;

holding the piece of wood upright with the saddle member; and directing a hammer blow to an upper end of the piece of wood.

30. A manually operated apparatus for splitting wood, the apparatus comprising:

at least one axe-shaped blade extending from a support base;

the at least one axe-shaped blade having an upward facing cutting edge, wherein the at least one axe-shaped blade is structured and arranged to receive thereon a lower end of a piece of wood so that the piece of wood can be split by a hammer blow directed to an upper end of the piece of wood; and a pivotally mounted saddle member comprising a portion which is structured and arranged to hold the piece of wood upright at the moment when the piece of wood receives the hammer blow.

31. A method of splitting wood in the apparatus of claim 30, the method comprising:

arranging the lower end of the piece of wood on the cutting edge of the at least one axe-shaped blade;

holding the piece of wood upright with the portion of the saddle member; and directing a hammer blow to an upper end of the piece of wood.

32. A manually operated apparatus for splitting wood, the apparatus comprising:

at least one axe-shaped blade removably connected to a support base;

the at least one axe-shaped blade having an upward facing cutting edge, wherein the at least one axe-shaped blade is structured and arranged to receive thereon a lower end of a piece of wood so that the piece of wood can be split by a hammer blow directed to an upper end of the piece of wood; and a movably mounted saddle member comprising a portion which is structured and arranged to hold the piece of wood upright at the moment when the piece of wood receives the hammer blow.

33. A method of splitting wood in the apparatus of claim 32, the method comprising:

arranging the lower end of the piece of wood on the cutting edge of the at least one axe-shaped blade;

holding the piece of wood upright with the portion of the saddle member; and directing a hammer blow to an upper end of the piece of wood.

* * * * *